US008191267B2

(12) United States Patent
Patel et al.

(10) Patent No.: US 8,191,267 B2
(45) Date of Patent: Jun. 5, 2012

(54) TOOL WITH REPLACEABLE BLADE

(75) Inventors: Amar Arvind Patel, South Barrington, IL (US); Aaron Charles Rosso, Chicago, IL (US); Matthew Earle Myers, Naperville, IL (US); Scott Fong, Causeway Bay (HK)

(73) Assignee: United States Gypsum Company, Chicago, IL (US)

( * ) Notice: Subject to any disclaimer, the term of this patent is extended or adjusted under 35 U.S.C. 154(b) by 281 days.

(21) Appl. No.: 11/966,746

(22) Filed: Dec. 28, 2007

(65) Prior Publication Data

US 2009/0165311 A1 Jul. 2, 2009

(51) Int. Cl.
*B25G 3/02* (2006.01)

(52) U.S. Cl. ..... 30/339; 30/342

(58) Field of Classification Search ..... 30/340, 30/342, 169, 329, 337, 338, 339, 335, 162, 30/146, 147, 148, 149, 150, 322, 346.61; 15/105.5, 236.01; 81/489, 490; 83/698.31
See application file for complete search history.

(56) References Cited

U.S. PATENT DOCUMENTS

| | | | | | |
|---|---|---|---|---|---|
| 117,892 | A | * | 8/1871 | Johnson | 30/113.1 |
| 545,528 | A | * | 9/1895 | Paul | 42/53 |
| 845,340 | A | * | 2/1907 | Drew | 279/104 |
| 1,030,321 | A | | 6/1912 | Müller | |
| 1,458,171 | A | | 6/1923 | Donaldson | |
| 1,705,205 | A | * | 3/1929 | Reams | 81/490 |
| 3,308,533 | A | * | 3/1967 | Holohan | 30/32 |
| 3,367,335 | A | * | 2/1968 | Ward et al. | 606/167 |
| 3,853,495 | A | | 12/1974 | Shire | |
| 4,106,181 | A | | 8/1978 | Mattchen | |
| 4,292,738 | A | | 10/1981 | Osada | |
| 4,386,609 | A | | 6/1983 | Mongeon | |
| 4,524,514 | A | | 6/1985 | Mallalieu et al. | |
| 4,794,694 | A | | 1/1989 | Daniel et al. | |
| 5,005,293 | A | * | 4/1991 | Di Amico | 30/322 |
| 5,155,913 | A | | 10/1992 | Marttiini | |
| RE34,979 | E | | 6/1995 | Gringer | |
| 5,575,030 | A | | 11/1996 | Girard | |
| 5,617,635 | A | * | 4/1997 | Berns | 30/162 |
| 5,774,994 | A | * | 7/1998 | Stein et al. | 30/342 |
| 5,862,596 | A | * | 1/1999 | Chung | 30/162 |
| 5,933,916 | A | | 8/1999 | Loschelder | |
| 6,044,562 | A | * | 4/2000 | Dillenbeck | 30/162 |
| 6,047,476 | A | * | 4/2000 | Stein et al. | 30/342 |
| 6,055,733 | A | * | 5/2000 | Chen | 30/142 |
| 6,085,424 | A | * | 7/2000 | Mai | 30/169 |

(Continued)

FOREIGN PATENT DOCUMENTS

DE 4315495 A1 * 11/1994

*Primary Examiner* — Kenneth E. Peterson
*Assistant Examiner* — Jennifer Swinney
(74) *Attorney, Agent, or Firm* — Greer, Burns & Crain, Ltd.; Pradip Sahu; Philip T. Petti

(57) ABSTRACT

A tool handle for use with a removable blade having a latch opening, the tool handle having a housing defining a blade chamber in the housing, a latch disposed in the housing, configured for moving between a latched position and a released position. In the latched position, the latch is configured to extend through the latch opening. Also included is an actuator at least partially enclosed within the housing, configured for moving between a rest position and a depressed position, wherein movement of the actuator to the depressed position causes the latch to move to the released position.

7 Claims, 4 Drawing Sheets

U.S. PATENT DOCUMENTS

| | | | | |
|---|---|---|---|---|
| 6,161,290 | A * | 12/2000 | Takamasa | 30/162 |
| 6,256,889 | B1 * | 7/2001 | Zuro | 30/339 |
| 6,260,281 | B1 * | 7/2001 | Okumura et al. | 30/392 |
| 6,357,120 | B1 * | 3/2002 | Khachatoorian et al. | 30/162 |
| 6,886,257 | B2 | 5/2005 | Chih | |
| 7,287,449 | B2 * | 10/2007 | Abel et al. | 81/177.2 |
| 7,316,070 | B2 * | 1/2008 | Green | 30/162 |
| 7,448,136 | B2 * | 11/2008 | Huang | 30/125 |
| 2003/0024126 | A1 * | 2/2003 | Liu | 30/340 |
| 2003/0097759 | A1 * | 5/2003 | Bond et al. | 30/340 |
| 2004/0104259 | A1 * | 6/2004 | Sprenger et al. | 227/10 |
| 2005/0188541 | A1 | 9/2005 | Brown et al. | |
| 2005/0193566 | A1 | 9/2005 | Brown et al. | |
| 2005/0193567 | A1 * | 9/2005 | Ho | 30/162 |
| 2005/0246901 | A1 * | 11/2005 | Chengdao et al. | 30/166.3 |
| 2006/0174495 | A1 * | 8/2006 | Jumior | 30/339 |
| 2006/0241664 | A1 * | 10/2006 | Lam | 606/167 |
| 2008/0289190 | A1 * | 11/2008 | Jennings et al. | 30/155 |

* cited by examiner

TOOL WITH REPLACEABLE BLADE

BACKGROUND OF THE INVENTION

The present invention relates generally to hand tools using blades, and more specifically to wallboard taping knives and similar tools.

A wallboard taping knife or scraper typically has a large blade with an elongate working edge attached to a handle. As is well known in the art, such tools are used for spreading joint compound over wallboard tape to finish joints of adjacent wallboard panels. Users typically repeatedly dip the knife blade into a container of wallboard joint compound known as a mud pan, and also scrape excess compound from the blade against an edge of the mud pan. Due to the operator stresses on the blade from these various repetitive activities, it is preferred to have the blade well secured to the handle such that there is no play or independent relative movement between the blade and handle. A strong connection between the blade and handle increases operational life of the tool and reduces user fatigue. Thus, one design criteria of such a tool is to reduce independent movement of the blade relative to the handle. Conventional drywall tools address this concern by manufacturing the tool such that the blade is permanently attached to the handle of the tool.

A significant portion of operational wear on taping knives is incurred on the blade edge or at the point where the blade meets the handle. As the blade becomes worn, it becomes more difficult to evenly apply the compound. Since conventional tools have blades that are permanently attached to the tool, when the blade becomes worn, the entire tool must be replaced. Another design criteria of taping knives is maintaining user comfort during periods of extended use.

Utility knives and other tools with replaceable blades are known in the art. However, in such tools removing the blade involves unscrewing and/or opening the tool housing, resulting in a complicated and time-consuming process.

BRIEF SUMMARY OF THE INVENTION

The above-listed needs are met or exceeded by the present tool, which features a releasably attachable blade that is removable upon depressing an actuator. When the actuator is in a rest position, a latch is in a latched position and extends through a latch opening in the blade, thereby securely attaching the blade to a tool handle. When the actuator is depressed, an actuator extension on the actuator engages a complementary latch extension on the latch, causing the latch to retract from a latched position to a released position such that the latch no longer extends through the latch opening, thus allowing the blade to be removed from the tool handle.

More specifically, a tool handle is provided for use with a removable blade having a latch opening, the tool handle having a housing defining a blade chamber in the housing, a latch disposed in the housing, configured for moving between a latched position and a released position. In the latched position, the latch is configured to extend through the latch opening. Also included is an actuator at least partially enclosed within the housing, configured for moving between a rest position and a depressed position, wherein movement of the actuator to the depressed position causes the latch to move to the released position.

DETAILED DESCRIPTION OF THE INVENTION

Figure 1:
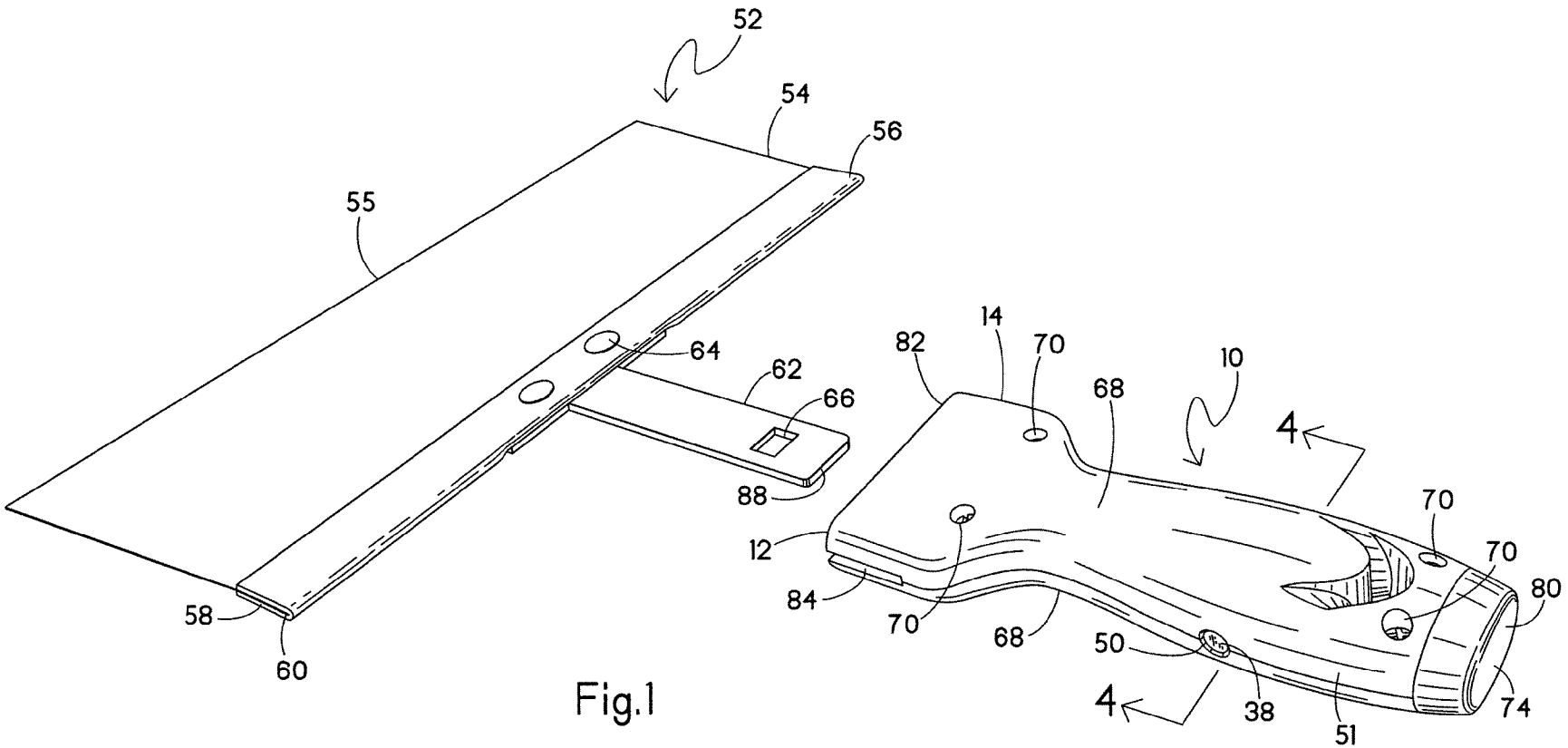
FIG. 1 is an exploded top perspective view of the present tool.
Figure 2:
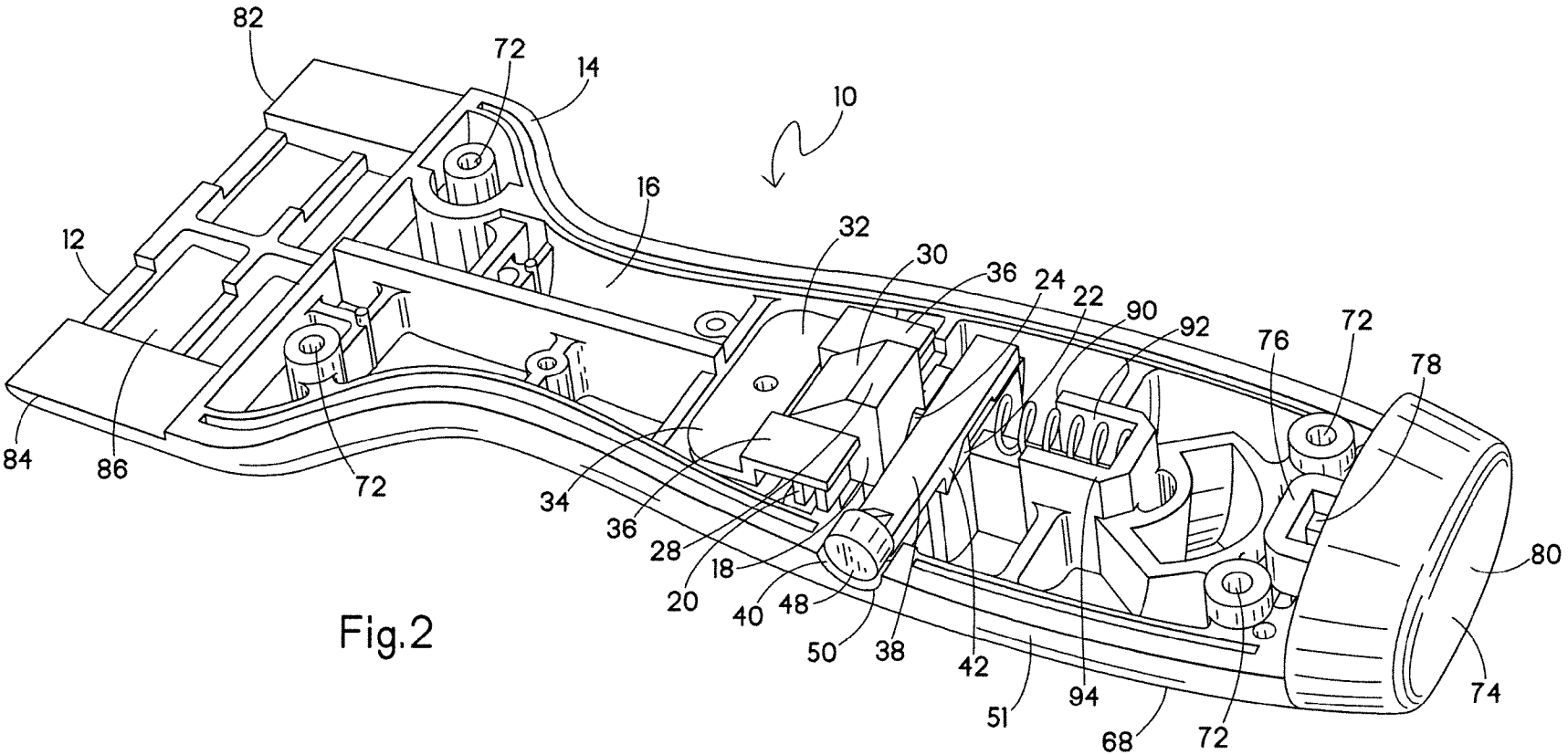
FIG. 2 is a fragmentary perspective view of the tool handle with portions removed for clarity.
Figure 3:
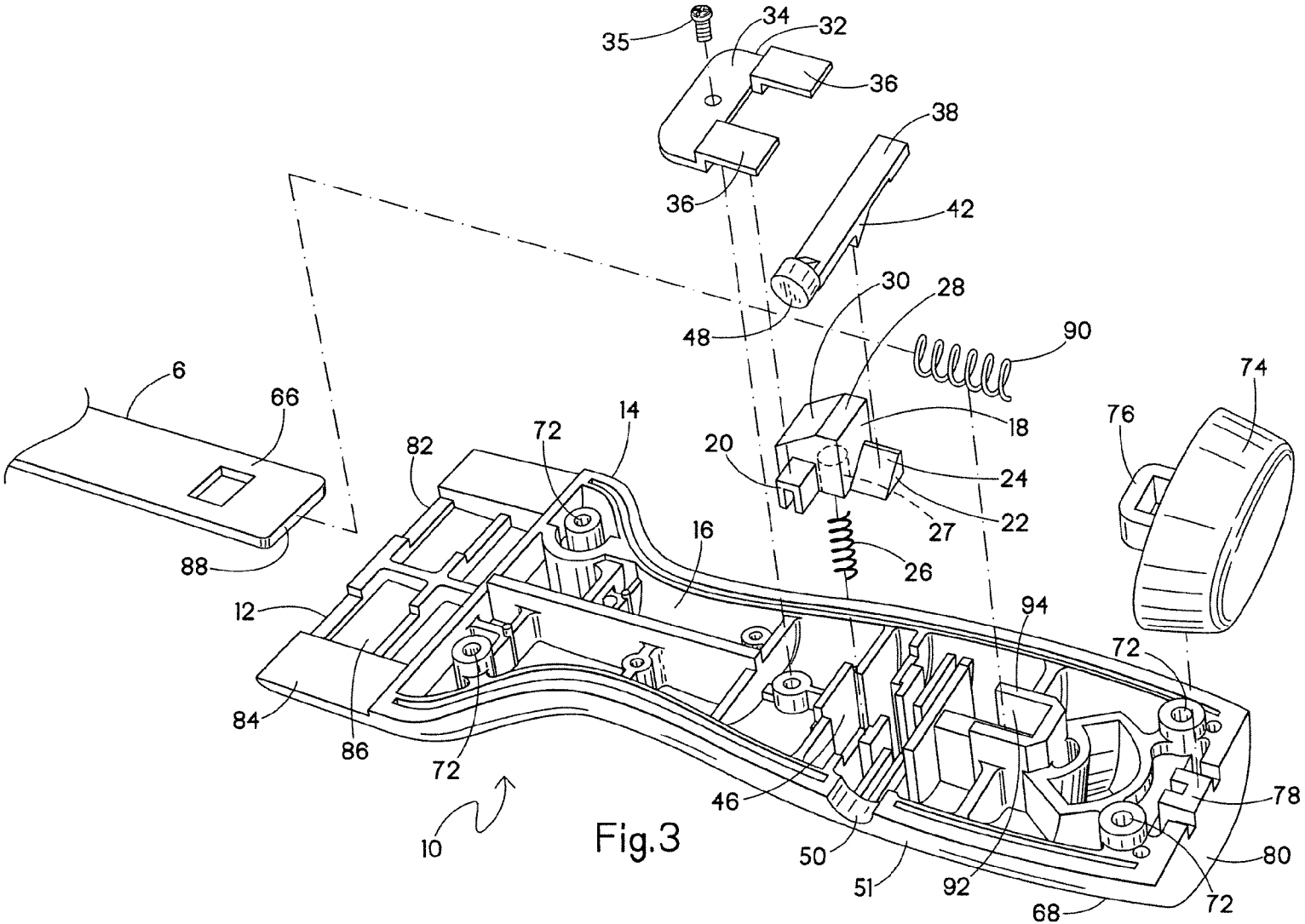
FIG. 3 is an exploded top perspective view of the tool of FIG. 1 showing components of the tool handle, with portions removed for clarity.

Referring now to FIGS. 1-3, a tool is generally designated 10 and has a tool handle 12 with a housing 14 defining a blade chamber 16. A latch 18 is disposed in the housing 14 and is configured and arranged to move between a latched position (FIG. 4) and a released position (FIG. 5). In the preferred embodiment, the latch 18 has at least one, but preferably two latch shoulders 20 extending laterally from the latch transversely to a longitudinal axis of the tool handle 12. Also included on the latch 18 is a generally wedge-shaped latch formation 22 generally extending along the handle longitudinal axis and having a latch inclined surface 24 forming a plane facing transverse to the handle longitudinal axis.

Figure 4:
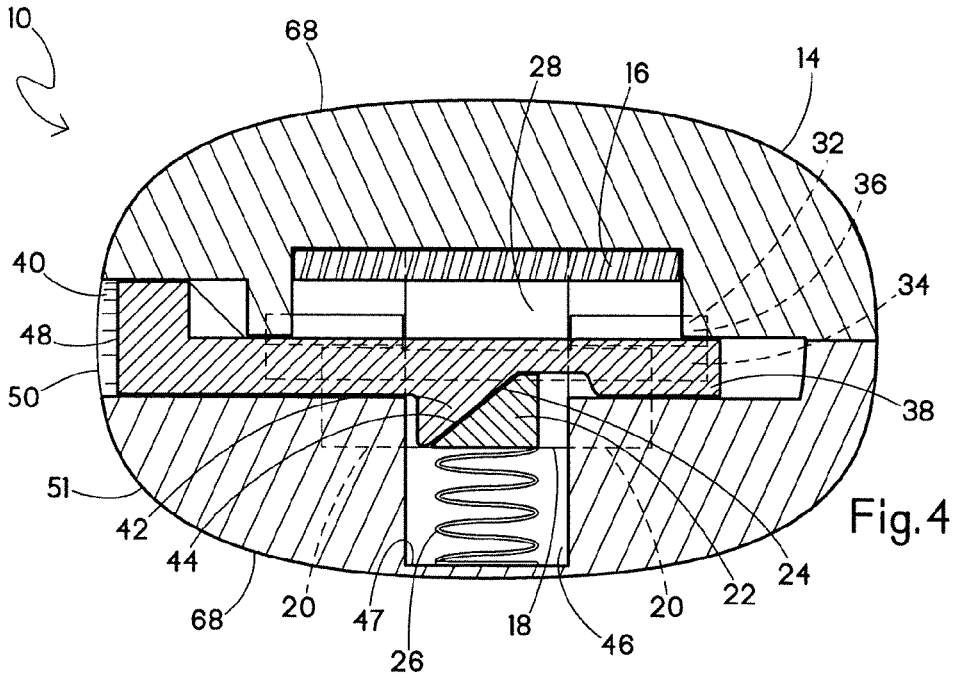
FIG. 4 is cross-section taken along the line 4-4 of FIG. 1 and in the direction indicated generally.
Figure 5:
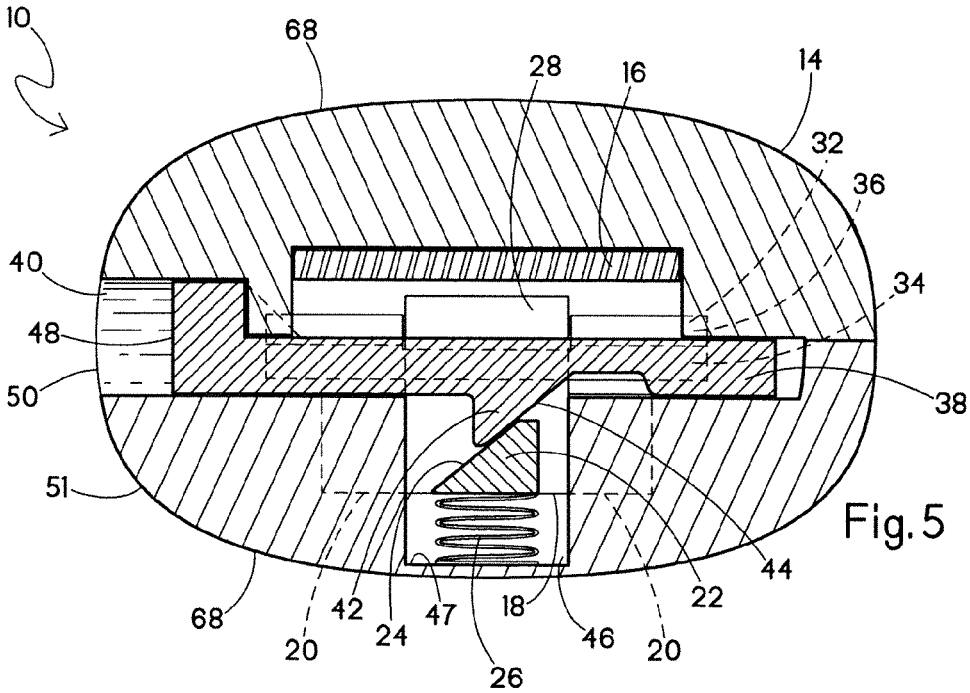
FIG. 5 is a cross-section similar to FIG. 4 showing the actuator is in a depressed position.

A biasing device 26, preferably a spring, is associated at one end with the latch 18, and at the other end with the housing 14, such that the latch is urged into the latched position (FIG. 4). More specifically, the biasing device 26 is located in and depends from a corresponding socket 27 (shown hidden in FIG. 3) in the latch 18. The latch 18 also has a lug 28 having a lug inclined surface 30 facing the blade chamber 16.

A latch retainer 32 having two portions is disposed in the housing 14. A first retainer portion 34 is mounted, preferably using a fastener such as a screw 35 (FIG. 3), to the housing 14, and a second retainer portion 36 is associated with and engages the two latch shoulders 20 such that the latch retainer 32 resists the biasing force exerted on the latch 18 by the biasing device 26. It will be appreciated that the configuration and arrangement of the latch shoulders 20, the latch formation 22, and the latch retainer 32 may vary to suit the application.

An actuator 38 is disposed within the housing 14 and moves between a rest position (FIG. 4) and a depressed position (FIG. 5). In a preferred embodiment, the actuator 38 is elongate-shaped and is disposed in an actuator cavity 40 defined by the housing 14. Preferably, the actuator 38 has a depending, generally wedge-shaped actuator formation 42 with an actuator inclined surface 44 such that the actuator formation 42 complements the latch formation 22. Preferably, the housing 14 defines a formation cavity 46 wherein the actuator formation 42, the latch formation 22, and the biasing device 26 are all disposed.

Also, the formation cavity 46 has a floor 47 (FIGS. 4 and 5), which receives an end of the biasing device 26. The biasing device 26 urges the latch 18 into the latched position, which in turn exerts force on the actuator 38, by way of the engagement between the latch formation 22 and the actuator formation 42. Therefore, the actuator 38 is normally urged into the rest position, and can be said to be biased as well through its indirect engagement with the biasing device 26.

The actuator 38 includes a button-like actuator surface 48 accessible through an actuator opening 50 in a side of the housing 14. Preferably, the actuator surface 48 is generally flush with or slightly recessed inside an exterior surface 51 of the tool handle 12 such that a user would need a pointed instrument (e.g., a nail, pen, or the like) to exert a sufficient force on the actuator 38 to move it from the rest position to the depressed position. Also, the above-described relatively unobstructed arrangement of the actuator surface 48 maintains the generally smooth exterior surface 51 of the tool handle 12 to promote gripping comfort.

Referring again to FIGS. 1 and 3, the tool 10 is configured to be used with a removable blade, generally designated 52 (FIG. 1). The blade 52 has a blade working portion 54, preferably made of blued steel and rectangular shaped, although it is noted other shapes for taping knife blades are known in the art and typically relate to the length of an elongate working edge 55. A reinforcing backing plate 56 defines a blade slot 58 for receiving and supporting an upper blade edge 60 and couples the blade working portion 54 to a blade shank 62. At least one, and preferably two suitable fasteners 64 such as rivets, secure the blade working portion 54, the reinforcing backing plate 56, and the blade shank 62 together as a unit.

As is known to skilled practitioners in the art, the tool handle 12 is made up of two housing halves 68 forming the housing 14, which are secured by suitable fasteners 70 (FIG. 1) engaging corresponding bosses 72. A relatively hardened hammer 74 is mounted to the housing 14 by mating a loop and lug arrangement 76, 78 or by other fastening technologies known in the art. The hammer 74 is mounted to the housing 14 at an end 80 opposite a blade end 82 receiving the blade 52. At the blade end 82, the housing 14 includes a pair of lips 84 defining a space 86 for accommodating the reinforcing backing plate 56. Included on the blade shank 62 is a latch opening 66 being constructed and arranged to facilitate a releasable locking engagement with the lug inclined surface 30 on the lug 28 of the latch 18.

To attach the blade 52 to the tool handle 12, the user inserts the blade shank 62 into the blade chamber 16 through the blade end 82. Eventually, as the blade shank 62 progresses further into the blade chamber 16, the blade shank makes contact with the lug inclined surface 30 on the lug 28 of the latch 18. Initially, this contact prevents the blade shank 62 from moving further into the blade chamber 16. However upon the user exerting sufficient axial pressure on the blade 52 in the direction of the blade chamber 16, overcoming the biasing force of the biasing device 26, and causing the sloping nature of the lug inclined surface 30 to engage an end 88 of the blade shank 62, the latch 18 retracts into the released position. Application of further axial force on the blade 52 causes the blade shank 62 to move further into the blade chamber 16, during which the now retracted lug 28 on the latch 18 continues to press against the surface of the blade shank 62.

When the blade shank 62 is completely inserted into the blade chamber 16, a blade biasing device 90, disposed in a blade biasing device cavity 92 defined by a generally "U"-shaped biasing portion 94 of the housing 14, engages the blade shank 62. The blade biasing device 90 is positioned to exert an axial biasing force against the end 88 of the blade shank 62, reducing movement of the blade shank within the blade chamber 16.

When the blade shank 62 is fully inserted into the blade chamber 16, the latch 18 in the tool 10 is aligned with the latch opening 66 on the blade shank 62, allowing the latch to return from its released position and extend through the latch opening 66 by way of the biasing force of the biasing device 26. As a result, the latch 18 moves into the latched position and the blade 52 is releasably locked in the blade chamber 16.

Besides a gripping force or support provided by the housing halves 68 and the close tolerance of the blade chamber 16, a feature of the present tool 10 is that the blade 52 is releasable from, but also securely retained in the tool handle 12 to prevent relative blade/handle movement. More specifically, the blade is subjected to two biasing forces operating in different directions. In the preferred embodiment, the biasing device 26 exerts a retention force in a first direction, and the blade biasing device 90 exerts a retention force in a second, generally normal direction. In other words, once locked into the tool handle 12, the blade 52 is subject to an axial as well as a transversely directed retention force.

Referring now to FIGS. 4 and 5, when the blade 52 requires removal, the user exerts a force on the actuator surface 48, pressing it towards the inside of the tool handle 12, causing movement of the actuator 38 from the rest position (FIG. 4) to the depressed position (FIG. 5). Such movement causes the wedge-shaped actuator formation 42 to engage the opposing surface 24 of the complementary latch formation 22 such that progressive movement of the actuator 38 causes relative sliding of the opposing inclined surfaces 44, 24. Since the user-applied force exceeds the force of the biasing device 26, the latch inclined surface 24 and the latch 18 retracts to the released position.

When the latch 18 is sufficiently retracted, the lug 28 on the latch 18 no longer makes contact with the blade shank 62, thus allowing the blade shank to be removed from the blade chamber 16, permitting complete removal of the blade 52 from the tool handle 12. When the user releases the actuator surface 48, the force exerted on the latch 18 by the biasing device 26, which urges the latch 18 into the latched position, in turn exerts force on the actuator 38. The engagement between the inclined surfaces of the latch formation 22 and actuator formation 42 transmit this biasing force. Therefore, when the user releases the actuator surface 48, the latch 18 returns to the default latched position and the actuator 38 returns to the rest position.

While a particular embodiment of the present tool has been described herein, it will be appreciated by those skilled in the art that changes and modifications may be made thereto without departing from the invention in its broader aspects and as set forth in the following claims.

The invention claimed is:

1. A tool handle for use with a removable blade having a latch opening, the tool handle comprising:

a housing defining a blade chamber within said housing;

a latch that is one rigid piece and disposed in said housing, said latch configured for moving between a latched position and a released position, in said latched position, said latch being configured to extend through the latch opening;

the latch further comprising U-shaped latch shoulders;

a latch retainer comprising latch retainer portions configured to engage said latch shoulders;

a latch biasing device that is received within a socket located in the latch;

an actuator at least partially enclosed within said housing, configured for moving between a rest position and a depressed position, wherein movement of said actuator to said depressed position causes said latch to move to said released position; and said latch and said actuator having complementary surfaces comprising inclined planes that are in constant contact with one another and that are constructed and arranged to slide against each other to effectively bias said actuator to said rest position so that progressive movement of said actuator from said rest position to said depressed position results in progressive retraction of said latch from said latched position to said released position.

2. The tool handle of claim 1 wherein said latch biasing device is a spring.

3. The tool handle of claim 1 wherein said latch has a lug projecting transverse to a plane of the blade, and said lug has a lug inclined surface for facilitating engagement with the latch opening.

4. The tool handle of claim 1 wherein said housing defines an actuator cavity, and wherein said actuator is disposed in said actuator cavity.

5. A removable blade for use with a tool handle having a housing defining a blade chamber within the housing, a latch that is one rigid piece and disposed in the housing, configured for moving between a latched position and a released position, an actuator at least partially enclosed within the housing, configured for moving between a rest position and a depressed position wherein movement of the actuator to the depressed position causes the latch to move to the released position, the latch and actuator having complementary surfaces comprising inclined planes that are in constant contact with one another and that slidingly engage each other to effectively bias the actuator to the rest position so that progressive movement of the actuator from the rest position to the depressed position results in progressive retraction of the latch from the latched position to the released position, the removable blade comprising:

a blade working portion;

a blade shank associated with said blade working portion;

a latch opening in said blade shank constructed and arranged for receiving the latch wherein, in the latched position, the latch extends through said latch opening;

the latch further comprising U-shaped latch shoulders;

a latch retainer comprising latch retainer portions configured to engage said latch shoulders; and a latch biasing device that is received within a socket located in the latch.

6. A tool, comprising:

a tool handle having a housing defining a blade chamber within the housing;

a latch that is one rigid piece and disposed in the housing, said latch including a lug and a latch formation projection from said lug, said latch configured for moving between a latched position and a released position;

an actuator at least partially enclosed within the housing, configured for moving between a rest position and a depressed position wherein movement of the actuator to the depressed position causes the latch to move to the released position;

a removable blade having a blade working portion;

a blade shank associated with said blade working portion; and a latch opening in said blade shank constructed and arranged for receiving said lug wherein, in said latched position, said lug extends through said latch opening; and wherein said latch formation and said actuator have complementary surfaces comprising inclined planes that are in constant contact with one another and that slidingly engage each other to effectively bias said actuator to said rest position so that progressive movement of said actuator from said rest position to said depressed position results in progressive retraction of said latch from said latched position to said released position;

the latch further comprising U-shaped latch shoulders;

a latch retainer comprising latch retainer portions configured to engage said latch shoulders; and a latch biasing device that is received within a socket located in the latch.

7. The tool of claim 6 wherein the blade is subjected to two biasing forces operating in different directions.

* * * * *